US006299163B1

(12) United States Patent
Chen

(10) Patent No.: US 6,299,163 B1
(45) Date of Patent: Oct. 9, 2001

(54) TOY FOOTBALL PLAYER FIXING DEVICE FOR A TOY FOOTBALL FIELD

(76) Inventor: Ying Tse Chen, No. 632, Chung Shan North Road, Yung Kang City, Tainan Hsien (TW)

( * ) Notice: Subject to any disclaimer, the term of this patent is extended or adjusted under 35 U.S.C. 154(b) by 0 days.

(21) Appl. No.: 09/525,273

(22) Filed: Mar. 14, 2000

(51) Int. Cl.[7] ..... A63F 7/06; A63F 7/20

(52) U.S. Cl. ..... 273/108.52; 273/129 R; 273/108.54

(58) Field of Search ..... 273/108.1, 108.51, 273/108.52, 108.53, 108.54, 108.55, 108.56, 129 R, 129 V, 129 W; 446/97, 327, 366, 367

(56) References Cited

U.S. PATENT DOCUMENTS 4,138,110 * 2/1979 Hendrickson .
5,087,219 * 2/1992 Price .
5,137,276 * 8/1992 Monneret .
5,377,981 * 1/1995 Monneret .
5,641,163 * 6/1997 McCloud .
6,231,046 * 5/2001 Tien .

* cited by examiner

*Primary Examiner*—Sebastiano Passaniti
(74) *Attorney, Agent, or Firm*—Pro-Techtor International Services

(57) ABSTRACT

A toy football player fixing device for a toy football field includes a toy football player consisting of a front half body and a rear half body assembled with bolts, and a maneuver bar passing through and fixed with the toy football player. The front and the rear half body have respectively a semi-circular groove formed in the contact surface to define a circular hole for the maneuver bar to pass through and at least a projecting tab formed in one of the two semi-circular grooves to engage a recess formed in the maneuver bar to secure the toy football player with the maneuver bar not to rotate. Then the front and the rear half body are screwed tightly together with bolts on the maneuver bar easily and quickly, having a fine appearance.

3 Claims, 4 Drawing Sheets

TOY FOOTBALL PLAYER FIXING DEVICE FOR A TOY FOOTBALL FIELD

BACKGROUND OF THE INVENTION

This invent ion relates to a toy football player fixing device for a toy football field, particularly to one easily fixing on or taking a toy football player off a maneuvering bar and having a fine appearance.

A known conventional toy football player fixing device shown in FIG. 1 includes through holes 101 formed in two opposite walls of a toy football field 10 for maneuver bars 20 to pass through, and toy football players bodies 30 having a transverse hole 301 and a fix hole 301 formed respectively in a front and a rear side of each player body 30 and crossing with the transverse hole 301. Further, each maneuver bar 20 passes through the through hole 101 in one side of the toy football field 10, and through the transverse holes 301 and through the through hole 101 in the other side of the toy football field 10 and then fixed tightly with a fix ring 202. Lastly, a bolt 303 is put through the fix hole 302 of the toy football player 30 and through the through hole 201 of the maneuver bar 20 and screwed with a nut 304 behind the football player 30, completing combining the football player 30 with the maneuver bar 20.

As the maneuver bar 20 directly pass through the transverse hole 301 of the football player 30 and then screwed tightly with the fix ring 202, so after the player 30 is hung on the maneuver bar 20, the player 30 hides the through hole 201 of the maneuver bar 20 so that it is very hard to align the fix hole 302 of the player 30 to the through hole 201 of the maneuver bar 20 for insert the bolt 303 through the fix hole 302 and the through hole 201 only by guessing. Therefore, it takes much time to assemble the player 30 with the maneuver bar 20. Provided a toy player 30 becomes dirty or is broken and needed to be taken off and replaced with a new one, the bolt 303 has firstly to be screwed and removed to take off the old toy player 30 and replace a new one to be screwed with the bolt 303 again, repeating the troublesome process.

SUMMARY OF THE INVENTION

This invention has been devised to offer a toy football player fix device, which can fix or take off a toy football player on or from a maneuver bar easily and quickly.

The main feature of the invention is the toy football player consisting of a front half body and a rear half body screwed together, forming a circular hole in their contact surfaces after the front and the rear half body are screwed together and at least a projecting tab formed in the circular hole to engage a recess in a maneuver bar so as to fix the tot player with the maneuver bar easily and quickly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
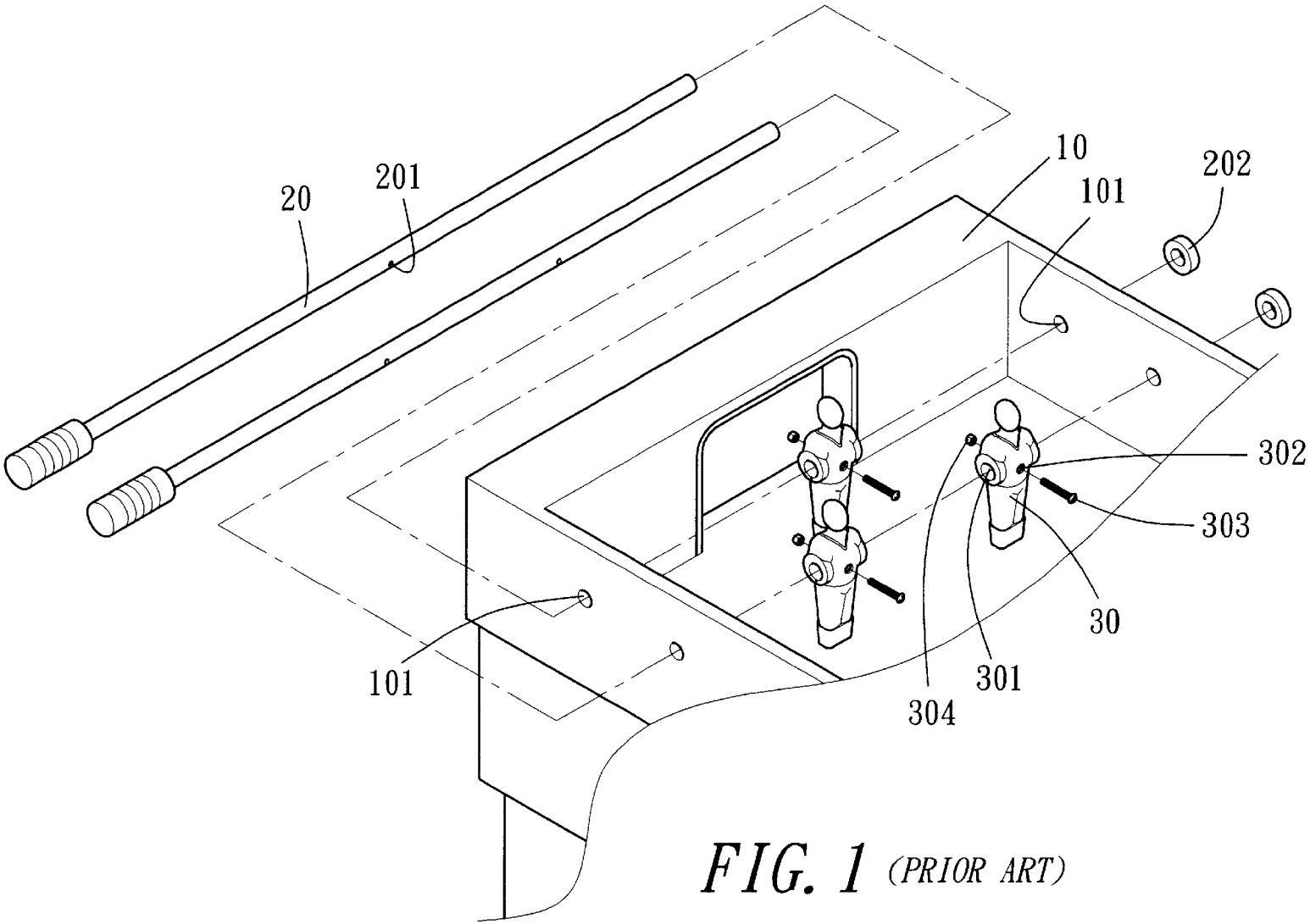
FIG. 1 (PRIOR ART)
FIG. 1 is an exploded perspective view of a known conventional football player fixing device for a toy football field.
Figure 2:
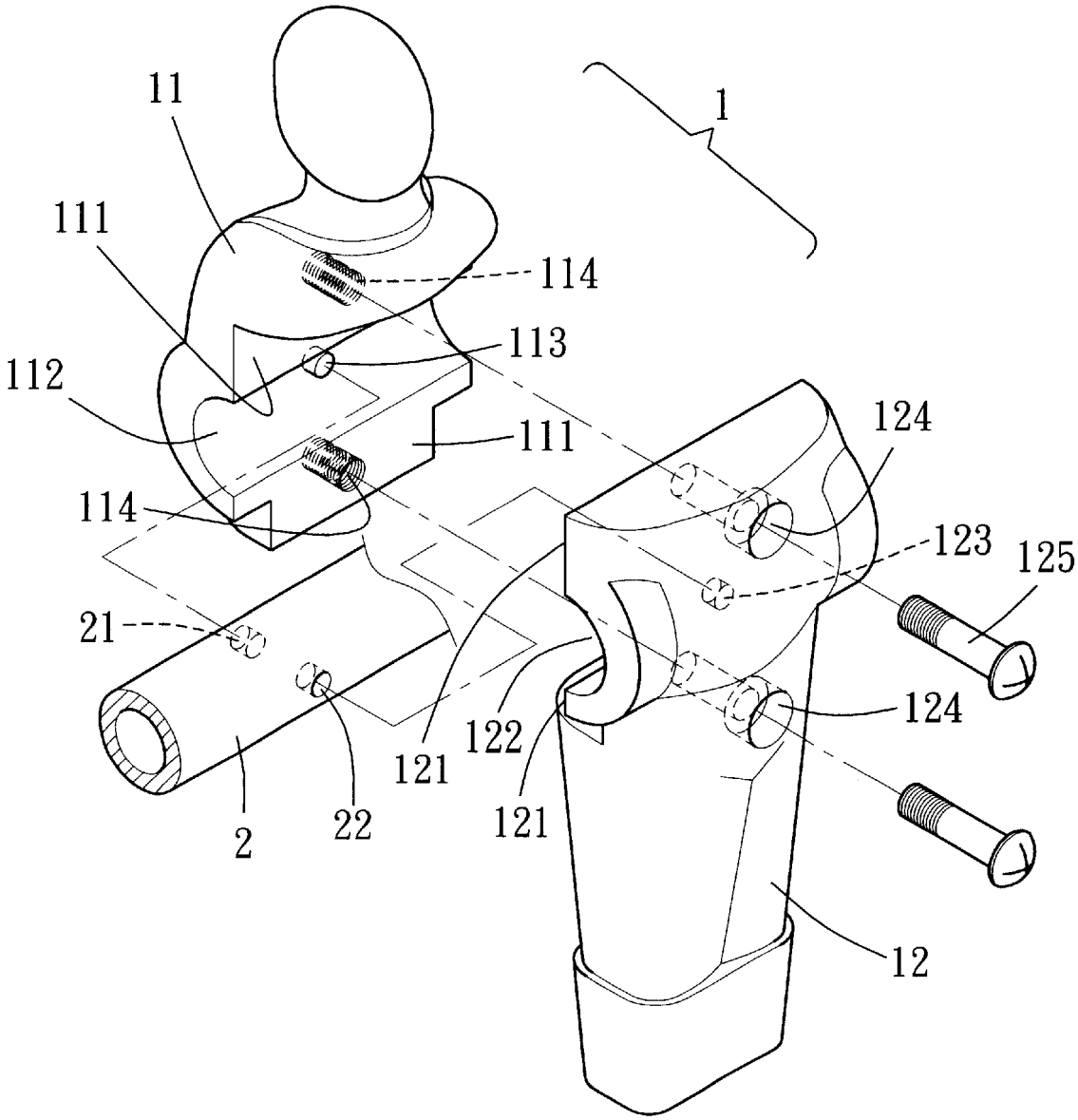
FIG. 2 is an exploded perspective view of a football player fixing device for a toy football field in the present invention.
Figure 3:
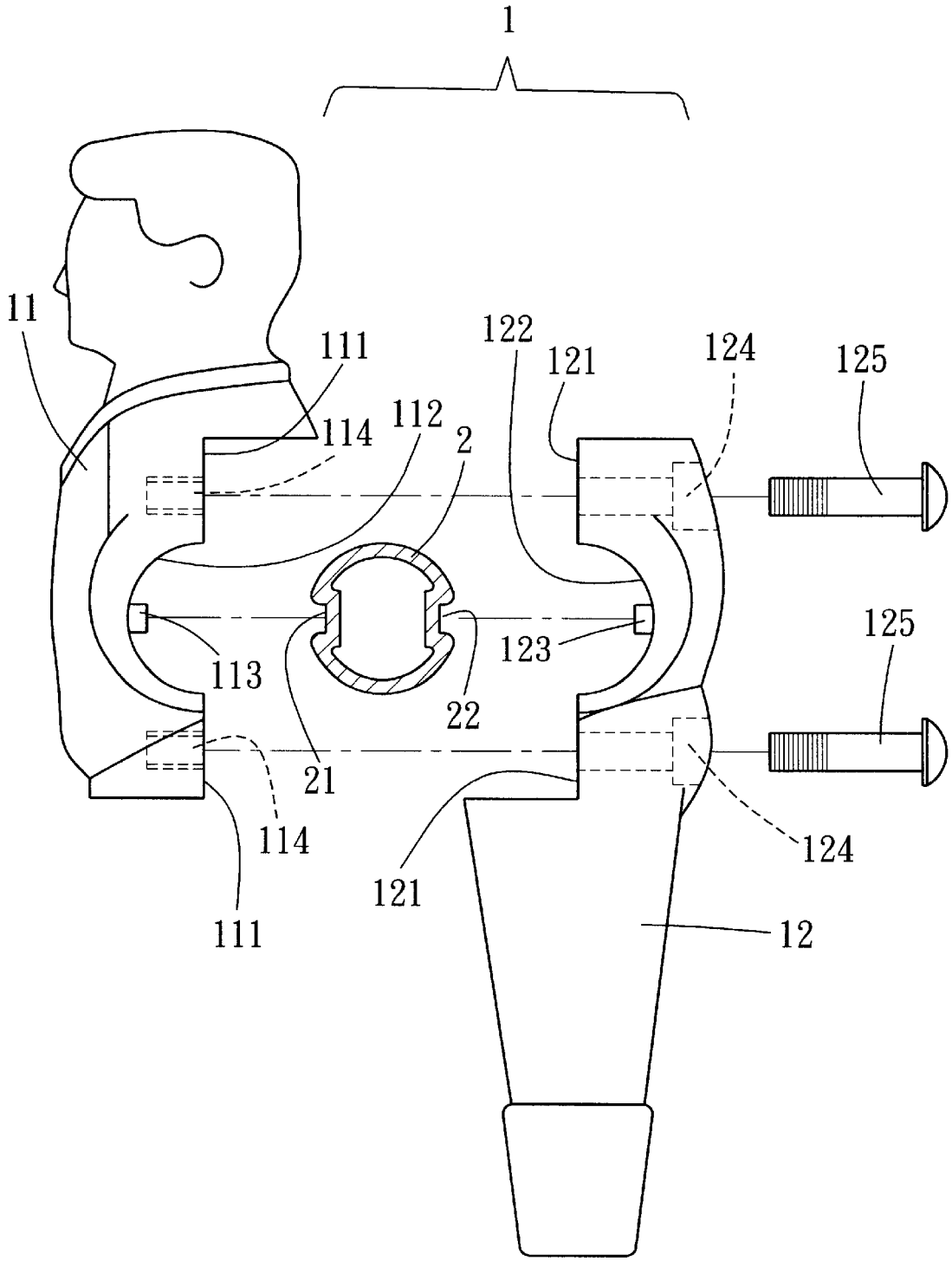
FIG. 3 is a side exploded view of the football player fixing device for a toy football field in the present invention; and, FIG. 4 is a side cross-sectional view of a football player fixed with the fixing device in the present invention.

A preferred embodiment of a toy football player fixing device for a toy football field, as shown in FIGS. 2 and 3, includes a plurality of toy football players 1 respectively consisting of a front half body 11 and a rear half body 12, and a plurality of maneuver bars 20.

The front and the rear half body 11 and 12 respectively have a contact surface 111, 121, a transverse semi-circular groove 112 122 respectively formed in the contact surfaces 111, 121, a position projecting tab 113, 123 respectively formed on the semi-circular grooves 11, 122. A threaded hole 114 is respectively formed above and below the semi-circular groove 112 in the contact surfaces 111 of the front half body 11, and a stepped hole 124 is respectively formed in the contact surface 112 of the rear half body 12, aligned to the threaded holes 114 of the front half body 11 for two bolts to screw with therein.

Figure 4:
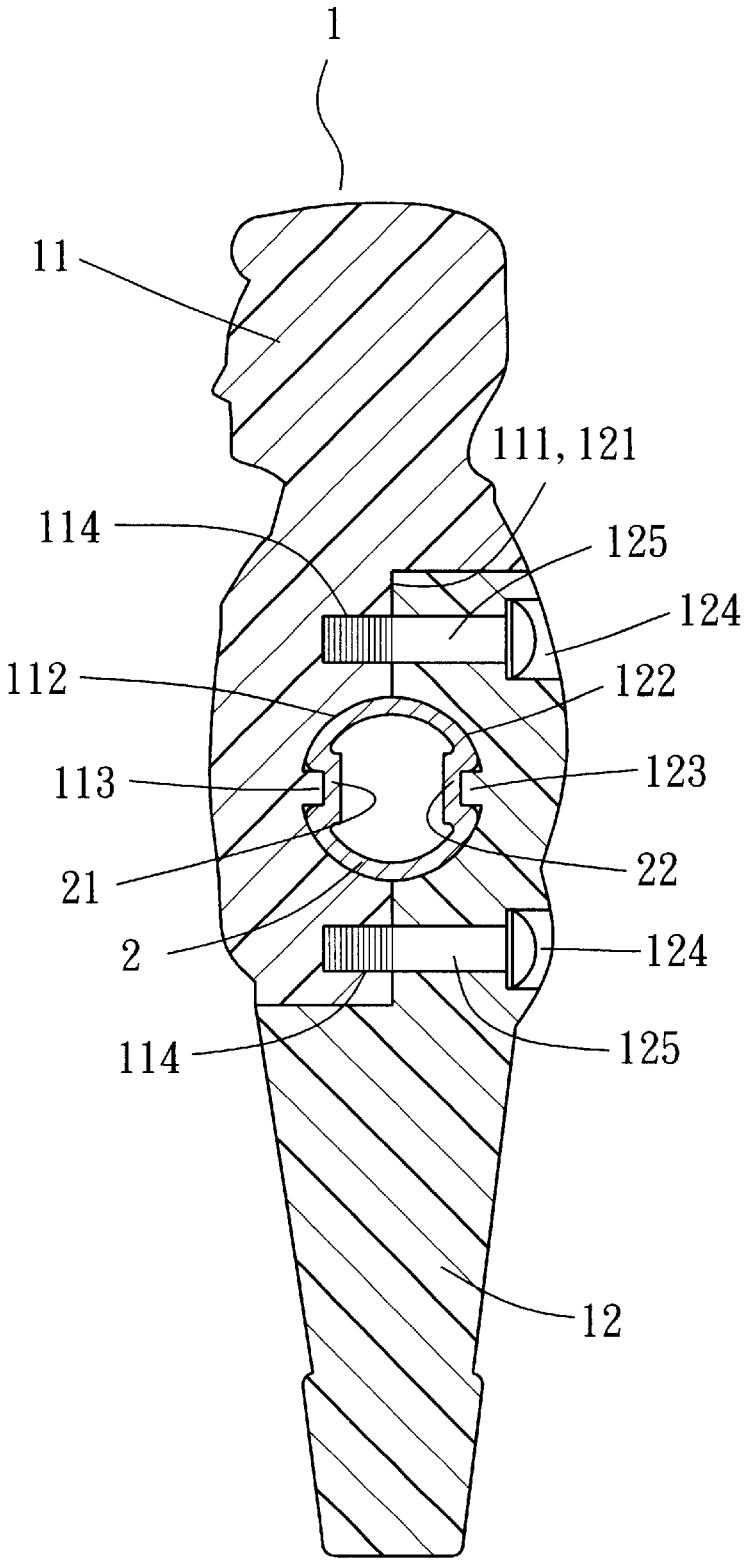

The maneuver bars 20 are elongate to have a proper length, extending through a circular hole defined by the two semi-circular grooves 112, 122 of the toy football player 1, having two opposite recesses 113, 123 formed on an outer surface for the position fix tabs 113, 123 of the toy player 1 to engage to secure the toy player 30 with each maneuver bar 20. As shown in FIG. 4, the fixing device of the toy football player 1 with the maneuver bar 20 is effected by the two semi-circular grooves 112, 122 surrounding the maneuver bar 20 and the two projecting tabs 113, 123 engaging the recesses 21, 22 of the maneuver bar 20, and in addition with the two bolts 125 screwing with the through holes 124 of the rear half body 12 and then in the threaded holes 114 of the front half body 11.

The invention has the following advantages, as can be understood from the aforesaid description 1. Toy football player 1 can be fixed with the maneuver bar 20 after the maneuver bar 20 is assembled with the toy football field 10, so if the toy football player 1 is needed to be taken off the maneuver bar 20, only screwing off the bolt 125 is enough to separate the front half body from the rear half body, But the known conventional one have to pull out the whole maneuver bar for taking off the toy football player.

2. The two projecting tabs 113, 123 on the semi-circular grooves 112, 122 of the front and the rear half body 11, 12 of the toy player 1 can steadily and quickly engage the recesses 21, 22 of the maneuver bar 20, without the need in the known conventional toy football player fixing device to blindly insert the bolt.

3. The bolts 124 are hidden, not exposing out, in the stepped holes 124 of the rear half body, looking neater than the known conventional toy football player with the bolt exposed out of the toy player.

While the preferred embodiment of the invention has been described above, it will be recognized and understood that various modifications may be made therein and the appended claims are intended to cover all such modifications which may fall within the spirit and scope of the invention.

What is claimed is:

1. A toy football player fixing device for a toy football field, comprising:

a toy football player and a maneuver bar, said toy football player consisting of a front half body and a rear half body screwed together on said maneuver bar, said front and said rear half body having respectively an inner contact surface fit with each other, a semi-circular horizontal groove formed respectively in said inner contact surfaces to define a circular hole after said front and said rear half body are screwed together for said maneuver bar to pass through said circular hole, at least one of said semi-circular grooves of said front and said rear half body having a projecting tab engaging a recess formed in an outer surface of said maneuver bar to secure said toy football player to said maneuver bar.

2. The toy football player fixing device for a toy football field as claimed in claim 1, wherein:

said semi-circular grooves of said front and said rear half body of said toy football player each have a projecting tab to engage two recesses formed in said outer surface of said maneuver bar to secure said toy football player to said maneuver bar.

3. The toy football player for a toy football field as claimed in claim 1, wherein:

said front half body and said rear half body of said toy football player are assembled by means of threaded holes formed in said contact surface of said front half body and stepped holes formed in the rear half body, said stepped holes are aligned with said threaded holes of said front half body, so that said stepped holes receive bolts that securely join said stepped holes and said threaded holes.

* * * * *